US006019540A

United States Patent [19]

Senior

[11] Patent Number: 6,019,540

[45] Date of Patent: Feb. 1, 2000

[54] DEVICES FOR INSERTING AND REMOVING LABELS

[75] Inventor: Richard McAlister Moorehouse Senior, Scarborough, United Kingdom

[73] Assignee: Duraweld Limited, North Yorkshire, United Kingdom

[21] Appl. No.: 09/088,101

[22] Filed: Jun. 1, 1998

[30] Foreign Application Priority Data

Jun. 4, 1997 [DE] Germany ..... 9711436

[51] Int. Cl.[7] ..... B42F 3/00; B42F 13/00; B42D 15/00; B42D 3/00

[52] U.S. Cl. ..... 402/81; 283/81; 281/31; 281/15.1; 281/36; 402/80 R; 402/73; 402/502

[58] Field of Search ..... 402/3, 80 R; 283/81; 281/31, 15.1, 36

[56] References Cited

U.S. PATENT DOCUMENTS

| | | | |
|---|---|---|---|
| D. 407,434 | 3/1999 | Moor | D19/32 |
| 1,677,277 | 7/1928 | Federbush et al. | 402/3 |
| 2,158,402 | 5/1939 | Chamberlin | 402/3 |
| 2,207,930 | 7/1940 | Miller . | |
| 4,172,332 | 10/1979 | Holes et al. | 402/3 |
| 4,828,421 | 5/1989 | Arakaki | 402/3 |
| 4,848,799 | 7/1989 | Turetsky | 283/101 |
| 4,892,333 | 1/1990 | Krulich . | |
| 4,998,840 | 3/1991 | Rubble | 402/3 |
| 5,330,279 | 7/1994 | Ruble | 402/3 |
| 5,711,627 | 1/1998 | Chapman | 402/3 |
| 5,876,143 | 3/1999 | Ong | 402/3 |

*Primary Examiner*—Willmon Fridie, Jr.
*Assistant Examiner*—Alisa L Thurston
*Attorney, Agent, or Firm*—Watts, Hoffman, Fisher & Heinke, Co

[57] ABSTRACT

A device for use in inserting a label into a holder or pocket comprises a pair of laminar members of low friction material of a size and shape corresponding generally to that of the label so as to be adapted to lie against opposite surfaces of the label to reduce frictional resistance between the label and the surfaces of the pocket to facilitate insertion of the label, a central portion of one of the members being removed at the end which is first inserted into the pocket and the other member being shorter in length, whereby following insertion pressure may be applied through the container or pocket to the portion of the label at said central location to hold the label in position during withdrawal of the device. An alternative form of device incorporates locating devices at intervals along its length for use in inserting labels of different length.

28 Claims, 3 Drawing Sheets

DEVICES FOR INSERTING AND REMOVING LABELS

This invention relates to a method and device for inserting and removing labels into and from transparent pockets forming part of or attached to binders, folders, document holders, wallets or the like.

Various forms of ring binders, document holders and the like are commonly employed in offices, colleges, at conferences and elsewhere for the collocation and retention of papers, documents, items of literature and the like. Conventionally these products are made of or have covers made of plastics materials such as PVC or polypropylene and frequently incorporate transparent panels or pockets into which identification labels, business cards or the like may be inserted. Typically ring binders incorporate back and front covers interconnected by a spine having a transparent cover or pocket into which an elongated label may be located to identify the contents of the binder. However due to the relatively long and narrow shape of the spine it is often extremely difficult to insert labels into the spinal pocket. Users therefore often resort to attaching adhesive labels which are unsightly and cannot be readily removed and replaced, or do not label the contents of the binder at all.

Likewise document holders or wallets into which papers may be loosely inserted, often incorporate transparent pockets adapted to receive business cards. A similar problem arises in such cases in that once cards have been inserted it is difficult to remove them. Some such pockets therefore incorporate a cut-out at the closed end of the pocket to enable the card to be pushed partly out of the pocket to facilitate removal, but the portion of the card exposed at the cut-out readily becomes marked or soiled which mars the appearance of the card. This is unsatisfactory in cases where the item is being used as a form of presentation packaging such as at conferences and the like.

It is an object of the present invention to provide a simple and effective means whereby labels, business cards and like items may be readily inserted into and removed from display panels, pockets or like containers without the difficulties and disadvantages referred to above.

The invention provides a device for use in inserting a label into a holder or pocket comprising a laminar member of low friction material of a shape and size corresponding generally to that of the label so as to be adapted to lie against a surface of the label to reduce frictional resistant between the label and a surface of the pocket to facilitate insertion of the label, a central portion of the member being removed at the end which is first inserted into the pocket, whereby following insertion pressure may be applied through the container or pocket to the portion of the label at said central location to hold same in position during withdrawal of the member from the pocket.

Preferably the device comprises two laminar members of low friction material adapted to be placed one on each side of the label at least one of said members having said central portion removed. The laminar members may advantageously be hinged together at one end.

If desired, a central portion may be removed from the leading end of both of said members. Alternatively, a central portion may be removed from one of said members, the other being of shorter length.

Preferably the device is provided with a tab or like projection adapted to extend beyond the trailing end of the label, whereby the projection may be gripped by the user to effect withdrawal of the member or members from the pocket following insertion of the label.

Advantageously the device is adapted for inserting and removing labels of different length, the member being at least as long as the longest label for which the device is designed and incorporating multiple means for temporarily attaching labels to the device at different positions depending on the length of the label.

Thus according to a further aspect of the invention there is provided a device for use in inserting labels of different length into holders or pockets, the device comprising a laminar member of low friction material adapted to lie against a surface of the label to reduce frictional resistance between the label and a surface of the pocket to facilitate insertion of the label, the laminar member being of a width corresponding generally to that of the labels to be inserted and being at least as long as the longest label for which the device is designed, the laminar member incorporating multiple locating means for temporarily attaching a label to the device at different positions dependent on the length of the label, and means enabling the label to be gripped through the holder or pocket after insertion to facilitate withdrawal of the device from the pocket leaving the label in position in the pocket.

Preferably said locating means comprise flap members formed at intervals along the length of the laminar member. The flap members are preferably provided by forming slits in the body of the laminar member defining tabs adapted to overlie the trailing ends of the respective labels.

According to a preferred arrangement the device comprises a pair of flexible laminar members of low friction plastics sheet material, the laminar members being hingedly connected together at one end and provided at the hinged end with a projecting tab member, a central recess being formed in the end of one of the members opposite the hinged ends, and the corresponding end of the other member being shorter than said one member, whereby the label may be placed between the members, the assembly inserted into the holder or pocket from one end, and direct pressure applied to the leading end of the label through the cover or pocket following insertion to enable withdrawal of the device by means of said tab member leaving the label in place in the holder or pocket.

The invention also provides a binder, folder, document holder, wallet or like article incorporating a panel, container or pocket adapted to receive an identification label or the like and a device for facilitating insertion or removal of a label into or from said container or pocket as aforesaid.

According to a further aspect of the invention there is provided a method of removing an identification label or the like from a container or pocket comprising inserting upper and lower laminar members of low friction material into the pocket above and below the label, applying pressure to the label and laminar members through the pocket and withdrawing the laminar members simultaneously while maintaining said pressure whereby to withdraw the label from the pocket.

Preferably the laminar members are of greater length than that of the label whereby following insertion they extend over the full length of the label and project from the pocket, thereby enabling the label to be entirely removed from the pocket by maintaining said pressure during withdrawal.

Embodiments of the invention will now be described, by way of example only, with reference to the accompanying drawings, in which.

Referring to FIGS. 1 to 4, there is shown a ring binder incorporating front and back covers 10 and 11 hingedly connected to opposite edges of a spine 12. The binder is formed from generally rigid board or card encased in plastics material such as polyvinylchloride (PVC). The outer surfaces of the covers and spine are protected by a film (13 and 14) of transparent PVC or polypropylene which is secured at the bottom and side edges but is not attached at the upper edges of the covers and spine. It is therefore possible to insert a label, cover sheet or the like between the transparent film and the associated cover or spine to identify the contents of the binder or to provide a decorative front or rear panel.

Suppliers of such binders commonly provide elongated labels adapted to be inserted into the pocket formed on the spine in order that the contents of the binder may be identified. However due to the relatively large surface area of the spine it is generally difficult to slide such labels into the spine pocket since the labels are usually made of paper and increasing resistance to movement is experienced the further the label is inserted and the greater the frictional resistance arising from surface contact with the transparent front cover and the spine itself, thus causing the label to crease or buckle.

Figure 1:
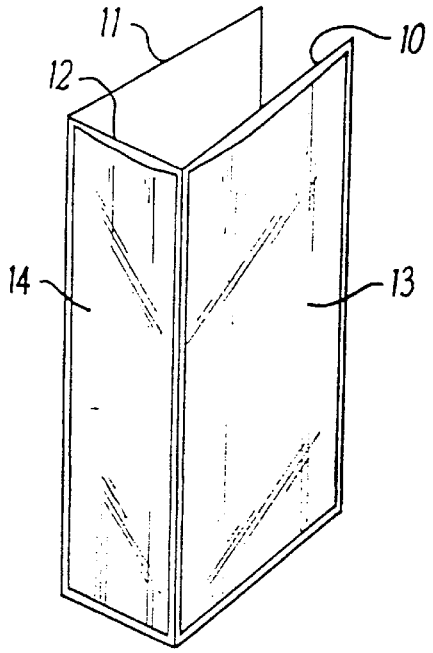
FIG. 1 is a perspective view of a ring binder incorporating a panel or pocket for an identification label.
Figure 2:
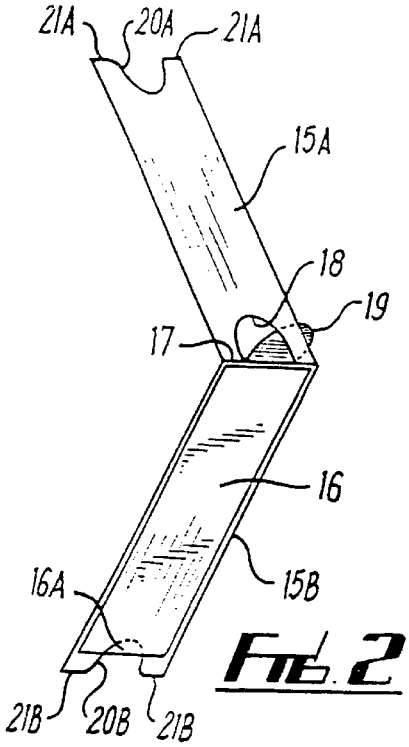
FIG. 2 is a perspective view of an identification label and an inserting device according to one embodiment of the invention.

FIG. 2 shows an insertion device according to one embodiment of the invention adapted to facilitate insertion of labels into the binder of FIG. 1. The device comprises a pair of laminar clamping members 15A and 15B corresponding generally in shape and size to that of the label 16 which is to be inserted. The clamping members are formed from a synthetic plastics material such as polyester film, suitable materials being Mylar (Registered Trade Mark) available from Du Pont, or Melinex (Registered Trade Mark) available from ICI. The clamping members are formed from a single sheet of material folded about a hinge line 17, an arcuate cut 18 being formed in the member 15A to produce a tab 19 which projects beyond the hinged connection 17 and is used to facilitate withdrawal of the device with or without the label. Arcuate recesses 20A and 20B and projecting ears or tongues 21A,21B are formed at the free ends of the respective members 15A and 15B, the recess 20A,20B also serving to facilitate withdrawal as described hereafter. The ears or tongues 21A,21B are rounded to prevent scratching or cutting of the pocket.

The dimensions of the device are determined by reference to the size of the pocket formed on the binder spine and of the label to be inserted into it. The width of the members 15A,15B corresponds substantially to the width of the label and pocket but their length is slightly greater than that of the label so that the ears 21A,21B project beyond the leading edge of the label which is exposed by the recesses 20A and 20B.

Figure 4:
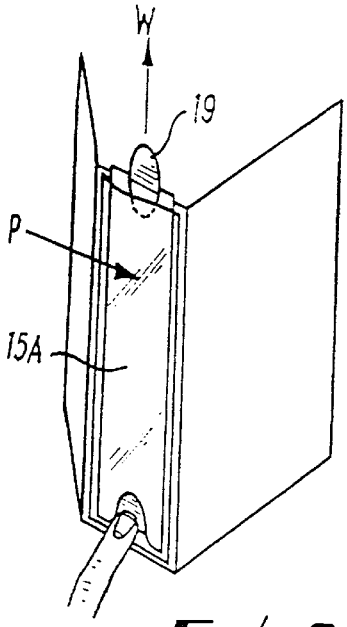
FIG. 4 is a perspective view showing the manner of withdrawing the device following insertion and of effecting removal of the label.

To insert the label it is placed between the laminar members 15A and 15B which are closed onto opposite sides of the label to serve as clamping members. The clamped assembly is then fed into the open end of the pocket 14 and slid down the spine. Initial insertion is facilitated by the ears 21A,21B. Sliding movement is facilitated by virtue of the low friction characteristics of the plastics material from which the device is constructed, assisted by the increased rigidity imparted to the label by the device. The reduction in friction is such that the device may be readily fed into the pocket carrying the label with it. When the device reaches its lowermost position in which the label is located fully within the pocket, the tab 19 of the device projects above the adjacent end of the spine. The device may then be removed by applying finger pressure through the pocket 14 to the exposed end portion 16A of the label and pulling the tab 19 upwardly as shown in FIG. 4. Since the label is held at its lower end the device 15 readily slides out of the pocket leaving the label in position.

In order to remove the label the device is inserted into the pocket from the open end with the members 15A and 15B positioned on opposite sides of the label. The device is then fed downwardly into the position shown in FIG. 4 and the label may then be removed by applying pressure at the upper region (P) of the spine and simultaneously pulling the tab 19 upwardly as viewed in FIG. 4. The pressure applied at zone P causes the label to be gripped between the members 15A,15B and withdrawn with the device.

Figure 3:
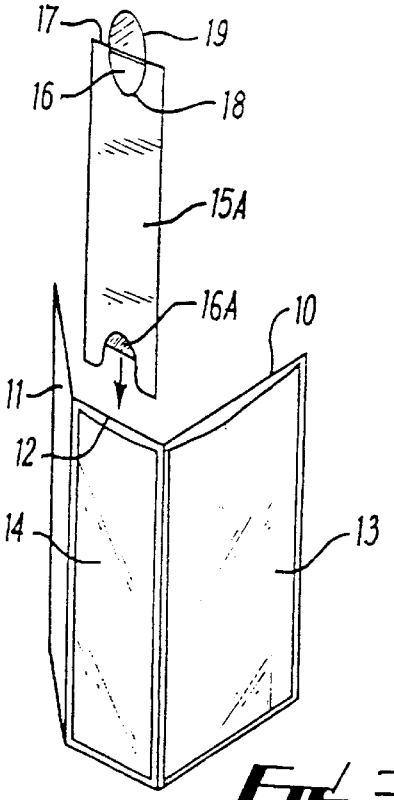
FIG. 3 is a perspective view illustrating the manner of inserting the label.

The device of FIGS. 2 to 4 therefore enables easy insertion and removal of labels into and from the spine of a ring binder of the kind shown in FIG. 1. Similar devices may be used in other situations including, for example, insertion of a front sheet into the pocket formed on the front of the binder shown in FIG. 1. Generally it will be necessary for effective operation that the dimensions of the inserting device should be not less than those of the label to be inserted although a larger device may be used to insert a small label.

Figure 5:
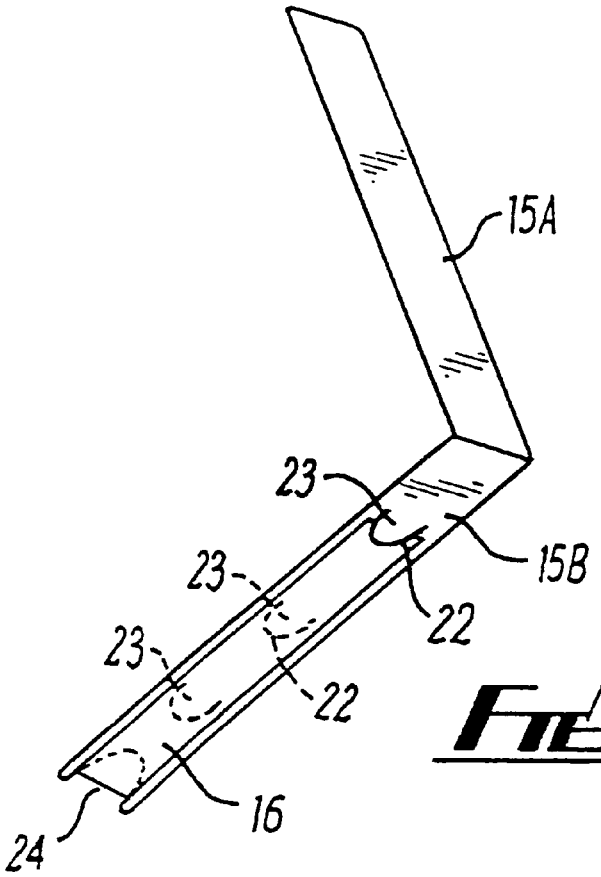
FIG. 5 is a perspective view of an alternative form of device for removing or inserting different sizes of label.
Figure 6:
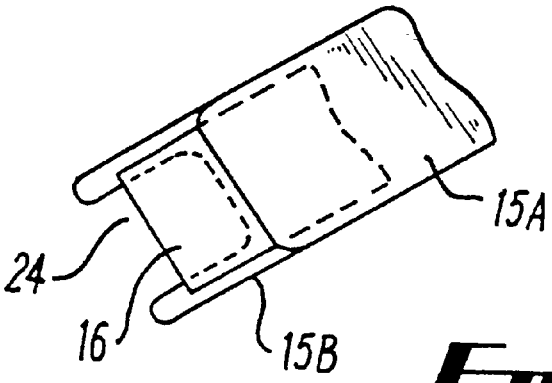
FIG. 6 is an enlarged perspective view of the leading end of the device of FIG. 5.

FIGS. 5 and 6 show a modified form of device for use with labels of different lengths. The device is generally similar to that of FIG. 2, but is provided with arcuate cuts 22 at intervals along the length of one of the clamping members 15B. The cuts 22 define tabs or flaps 23 under which the trailing end of a label 16 may be located. The upper clamping member is then closed over the lower member and label and the device inserted into the holder or pocket 14 on the binder as described with reference to FIG. 3.

The leading edges of the device of FIGS. 5 and 6 are also modified compared with the device of FIGS. 2. As best seen in FIG. 6, the leading edge of the lower member 15B has a central portion cut away to form a central recess 24 similar to the recess 20A of FIG. 2. However the upper member 15A is shorter than the lower member so that when the device is closed with the label between the upper and lower members, the former terminates just short of the inner end of the recess 24 in the lower member. This leaves the leading portion of the label 16 exposed and finger pressure may then be applied over the recess 24 to hold the label in place when the device is withdrawn in the manner described with reference to FIG. 4 of the drawings.

It will be appreciated that any desired number of tabs 23 may be provided at desired intervals on the member 15B to suit a desired range of lengths of label. When removing labels the device is employed as described with reference to the device of FIG. 2, but in order to avoid interference between the label and tabs 23 corresponding to other lengths of label, the tabs are pressed through the associated recesses to project to the rear rather than the front of the associated member 15B. When required to insert the label subsequently, the appropriate tab may be brought into a forward position to hold the label as previously described.

Figure 7:
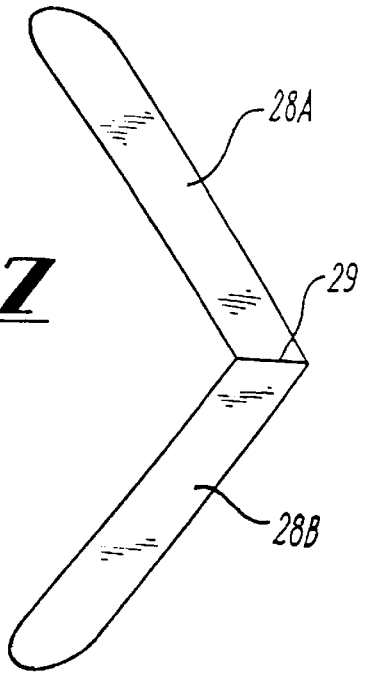
FIG. 7 is a perspective view of an alternative form of device for removing a label or card from a pocket.
Figure 8:
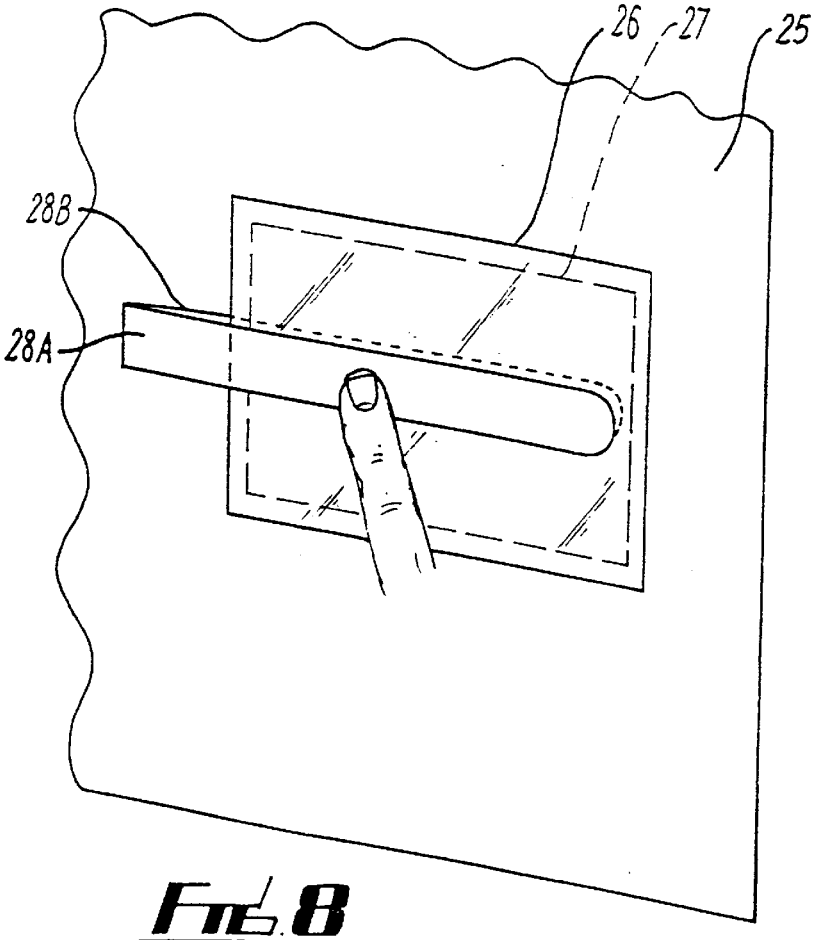
FIG. 8 is a fragmentary view showing use of the device of FIG. 7.

FIGS. 7 and 8 show an alternative form of device for use in removing business cards or the like from pockets on folders or other locations. FIG. 8 shows one corner of a document holder 25 to which a display pocket 26 is attached by adhesive. The front face of the pocket is transparent and the pocket enables a business card or the like 27 to be attached temporarily to the front face of the holder.

Due to the relative thickness of business cards and their relatively small area, there is generally no difficulty in inserting such cards into a pocket of the kind shown in FIG. 8. However removal is more difficult and FIG. 7 shows a simple form of device which may be used for this purpose. The device comprises a pair of elongated clamping members 28A,28B formed from a low friction material similar to that employed for the devices of FIGS. 1 to 6. The members 28A,28B are formed from a single piece of material folded about a hinge line 29.

In order to remove the card 27 from within the pocket 26, the device is inserted with the members 28A,28B disposed on opposite sides of the card. The card may then be removed by applying finger pressure through the outer surface of the pocket to the members 28A,28B and the card in the zone P. This causes the card to be clamped between the members 28A,28B without restricting the ability to withdraw the members from the pocket and to thereby effect removal of the card.

The arrangement of FIGS. 7 and 8 therefore enables business cards to be readily removed from pockets of the kind shown without causing damage to the cards or pockets thereby enabling folders to be readily re-labelled and cards to be re-used if required.

Various modifications may be made without departing from the invention. For example the shape and size of the devices may be altered substantially dependent primarily on the shape and size of the labels and pockets into which they have to be inserted or from which they are to be removed. While it is preferred that the device comprises a pair of clamping members adapted to locate on opposite sides of the label, a simple form of the device may comprise a single member adapted to be placed adjacent one surface of the label. In some cases the member could remain in place beneath the label if required, the tab or the like remaining projecting from the top of the pocket to facilitate subsequent removal if required. Moreover while the device is preferably made from synthetic plastics material other low friction and/or rigidfying materials such as card, board or the like may be employed if desired.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A device for use in inserting a label into a holder or pocket comprising a laminar member of low friction material of a shape and size corresponding generally to that of the label so as to be adapted to lie against a surface of the label to reduce frictional resistant between the label and a surface of the pocket to facilitate insertion of the label, a central portion of the member being removed at the end which is first inserted into the pocket, whereby following insertion pressure may be applied through the container or pocket to the portion of the label at said central location to hold same in position during withdrawal of the member from the pocket.

2. A device according to claim 1 comprising two laminar members of low friction material adapted to be placed one on each side of the label at least one of said members having said central portion removed.

3. A device according to claim 2 wherein the laminar members are hinged together at one end.

4. A device according to claim 3 wherein a central portion is removed from the leading end of both of said members.

5. A device according to claim 3 wherein a central portion is removed from the leading end of one of said members, the other of said members being of shorter length than said one of said members.

6. A device according to claim 3 having a projection extending beyond the trailing end of the label, whereby the projection may be gripped by the user to effect withdrawal of the members from the pocket following insertion of the label.

7. A device according to claim 1 adapted for inserting and removing labels of different length, the member being at least as long as the longest label for which the device is designed and incorporating multiple means for temporarily attaching labels to the device at different positions depending on the length of the label.

8. A device for use in inserting labels of different length into holders or pockets, the device comprising a laminar member of low friction material adapted to lie against a surface of the label to reduce frictional resistance between the label and a surface of the pocket to facilitate insertion of the label, the laminar member being of a width corresponding generally to that of the labels to be inserted and being at least as long as the longest label for which the device is designed, the laminar member incorporating multiple locating means for temporarily attaching a label to the device at different positions dependent on the length of the label, and means enabling the label to be gripped through the holder or pocket after insertion to facilitate withdrawal of the device from the pocket leaving the label in position in the pocket.

9. A device according to claim 8 wherein said locating means comprise flap members formed at intervals along the length of the laminar member.

10. A device according to claim 9 wherein said flap members are provided by forming slits in the body of the laminar member defining tabs adapted to overlie the trailing ends of the respective labels.

11. A device according to claim 8 comprising two laminar members of low friction material adapted to be placed one on each side of the label at least one of said members having a central portion removed at the end which is first inserted into the pocket to form said means enabling the label to be gripped.

12. A device according to claim 11 wherein the laminar members are hinged together at one end.

13. A device according to claim 12 wherein a central portion is removed from the leading end of both of said members.

14. A device according to claim 12 wherein a central portion is removed from the leading end of one of said members, the other of said members being of shorter length than said one of said members.

15. A device according to claim 12 having a projection extending beyond the trailing end of the label, whereby the projection may be gripped by the user to effect withdrawal of the members from the pocket following insertion of the label.

16. A device for use in inserting a label into a holder or pocket, the device comprising a pair of flexible laminar members of low friction plastics sheet material, the laminar members being hingedly connected together at one end and provided at the hinged end with a projecting tab member, a central recess being formed in the end of one of the members opposite the hinged ends, and the corresponding end of the other member being shorter than said one member, whereby the label may be placed between the members, the assembly inserted into the holder or pocket from one end, and direct pressure applied to the leading end of the label through the cover or pocket following insertion to enable withdrawal of the device by means of said tab member leaving the label in place in the holder or pocket.

17. An article of manufacture consisting of a selective one of a binder, folder, document holder, wallet, incorporating a panel, container, or pocket adapted to receive an identification label and a device for facilitating insertion or removal of the label into or from said container or pocket, the device comprising a laminar member of low friction material of a shape and size corresponding generally to that of the label so as to be adapted to lie against a surface of the label to reduce frictional resistant between the label and a surface of the pocket to facilitate insertion of the label, a central portion of the member being removed at the end which is first inserted into the pocket, whereby following insertion pressure may be applied through the container or pocket to the portion of the label at said central location to hold same in position during withdrawal of the member from the pocket.

18. An article according to claim 17 wherein said device comprises two laminar members of low friction material adapted to be placed one on each side of the label at least one of said members having said central portion removed.

19. An article according to claim 18 wherein the laminar members are hinged together at one end.

20. An articles according to claim 19 wherein a central portion is removed from the leading end of both of said members.

21. An article according to claim 19 wherein a central portion is removed from the leading end of one of said members, the other of said members being of shorter length than said one of said members.

22. An article according to claim 19 wherein said device has a projection extending beyond the trailing end of the label, whereby the projection may be gripped by the user to effect withdrawal of the members from the pocket following insertion of the label.

23. An article according to claim 17 adapted for inserting and removing labels of different length, wherein said member is at least as long as the longest label for which the device is designed and incorporating multiple means for temporarily attaching labels to the device at different positions depending on the length of the label.

24. An article of manufacture consisting of a selective one of a set of binders, folders, document holders, wallets, each incorporating a panel, container, or pocket of different length but essentially similar width adapted to receive an identification label and a device for use in inserting labels of different length into the respective holders or pockets, the device comprising a laminar member of low friction material adapted to lie against a surface of the label to reduce frictional resistant between the label and a surface of the pocket to facilitate insertion of the label, the laminar member being of a width corresponding generally to that of the labels to be inserted and being at least as long as the longest label for which the device is designed, the laminar member incorporating multiple locating means for temporarily attaching a label to the device at different positions dependent on the length of the label, and means enabling the label to be gripped through the holder or pocket after insertion to facilitate withdrawal of the device from the pocket leaving the label in position into the pocket.

25. An article according to claim 24 wherein said locating means comprise flap members formed at intervals along the length of the laminar member.

26. An article according to claim 25 wherein said flap members are provided by forming slits in the body of the laminar member defining tabs adapted to overlie the trailing ends of the respective labels.

27. A method of removing a label from a pocket-like container, the method comprising inserting upper and lower laminar members of low friction material into the pocket above and below the label, applying pressure to the label and laminar members through the pocket and withdrawing the laminar members simultaneously while maintaining said pressure whereby to withdraw the label from the pocket.

28. A method according to claim 27 wherein the laminar members are of greater length than that of the label, whereby following insertion they extend over the full length of the label and project from the pocket, thereby enabling the label to be entirely removed from the pocket by maintaining said pressure during withdrawal.

* * * * *

UNITED STATES PATENT AND TRADEMARK OFFICE

CERTIFICATE OF CORRECTION

PATENT NO. : 6,019,540

DATED : February 1, 2000

INVENTOR(S) : Richard McAlister Moorehouse, Sr.

It is certified that error appears in the above-identified patent and that said Letters Patent is hereby corrected as shown below:

On the title page item [30],

The Foreign Application Priority Data should read as follows: Jun. 4, 1997 [UK] United Kingdom 9711436

Signed and Sealed this

Thirteenth Day of February, 2001

Nicholas P. Godici

*Attest:*

NICHOLAS P. GODICI

*Attesting Officer*

*Acting Director of the United States Patent and Trademark Office*